US005170719A

United States Patent [19]

Pestone

[11] Patent Number: 5,170,719

[45] Date of Patent: Dec. 15, 1992

[54] HIDEAWAY WORK BENCH

[75] Inventor: William J. Pestone, Cohasset, Mass.

[73] Assignee: Crawford Products, Inc., West Hanover, Mass.

[21] Appl. No.: 791,456

[22] Filed: Nov. 13, 1991

[51] Int. Cl.[5] ..... A47B 5/00

[52] U.S. Cl. ..... 108/48; 211/104; 108/134

[58] Field of Search ..... 108/48, 134, 135, 47; 211/99, 100, 104, 57.1, 59.1; 312/316, 314

[56] References Cited

U.S. PATENT DOCUMENTS 4,155,609 5/1979 Skafte et al. ..... 108/48

5,040,468 8/1991 Miller et al. ..... 108/47

FOREIGN PATENT DOCUMENTS 2466217 4/1981 France ..... 108/48

*Primary Examiner*—Kenneth J. Dorner

*Assistant Examiner*—Gerald Anderson

*Attorney, Agent, or Firm*—Samuels, Gauthier & Stevens

[57] ABSTRACT

A portable, collapsible workbench is provided which may be secured to the upper edge of a door. A perforated back panel is provided with tubes secured to opposite edges, the tops of the tubes have clamps to be attached to the door. A benchtop is pivotally secured to the lower ends of the tubes. The benchtop is pivoted between two a horizontal position in use and a vertical position below the back panel for storage. Legs are pivotally secured to the end of the benchtop opposite the tube to support the benchtop in the horizontal position. The legs are folded parallel to the benchtop in the vertical position.

5 Claims, 2 Drawing Sheets

HIDEAWAY WORK BENCH

BACKGROUND OF THE INVENTION

The invention relates to a portable, collapsible workbench.

BACKGROUND AND BRIEF SUMMARY OF THE INVENTION

In many living and work areas, space is limited and a stand-alone workbench is not feasible. Portable workbenches currently available, even when in their collapsed positions, still tend to fill considerable space. Further, these workbenches are generally intended for heavy duty work and therefore are not that readily moveable from one place to another. A collapsible, moveable workbench, which could be stored flat, such as against a door, and only extend out from the door a few inches would be desirable.

The present invention embodies a moveable workbench which is configured to be hung from the upper edge of a door. The workbench functions between a closed and an open position. When in its closed position, it extends approximately a few inches from the door on which it is hung.

Broadly the invention comprises a substantially rectangular, perforated back having an upper edge, a lower edge and two sides. Secured to the back are a pair of upper hang tubes having apertured upper and lower ends which extend beyond the upper and lower edges of the back. Secured to the upper ends of the tubes are clamps whereby the tubes may be secured to the upper edge of a door or the like.

Secured to the lower ends of the tubes is a planar benchtop. The benchtop comprises a leading and a trailing edge. The trailing edge is rotatably joined to the lower ends of the hang tube. Secured to the leading edge of the workbench are depending legs having lower and upper ends. The upper ends of the legs are rotatably joined to the leading edge of the benchtop and are adapted to move between an open position wherein they are substantially perpendicular to the plane of the benchtop and a closed position where they are parallel to the plane of the benchtop. The legs are spaced such that they are dimensionally smaller than the distance between the hanging tubes. Thus the legs fold under the benchtop and the benchtop rotates downwardly, thus ensuring that the bench and its workbench in its closed position is substantially flat.

In a preferred embodiment, the trailing edge of the benchtop is configured to be secured to the door which supports the workbench. Also the legs are structural to be secured to the underside of the workbench when the legs are in their closed position.

DESCRIPTION OF THE PREFERRED EMBODIMENT(S)

Figure 1:
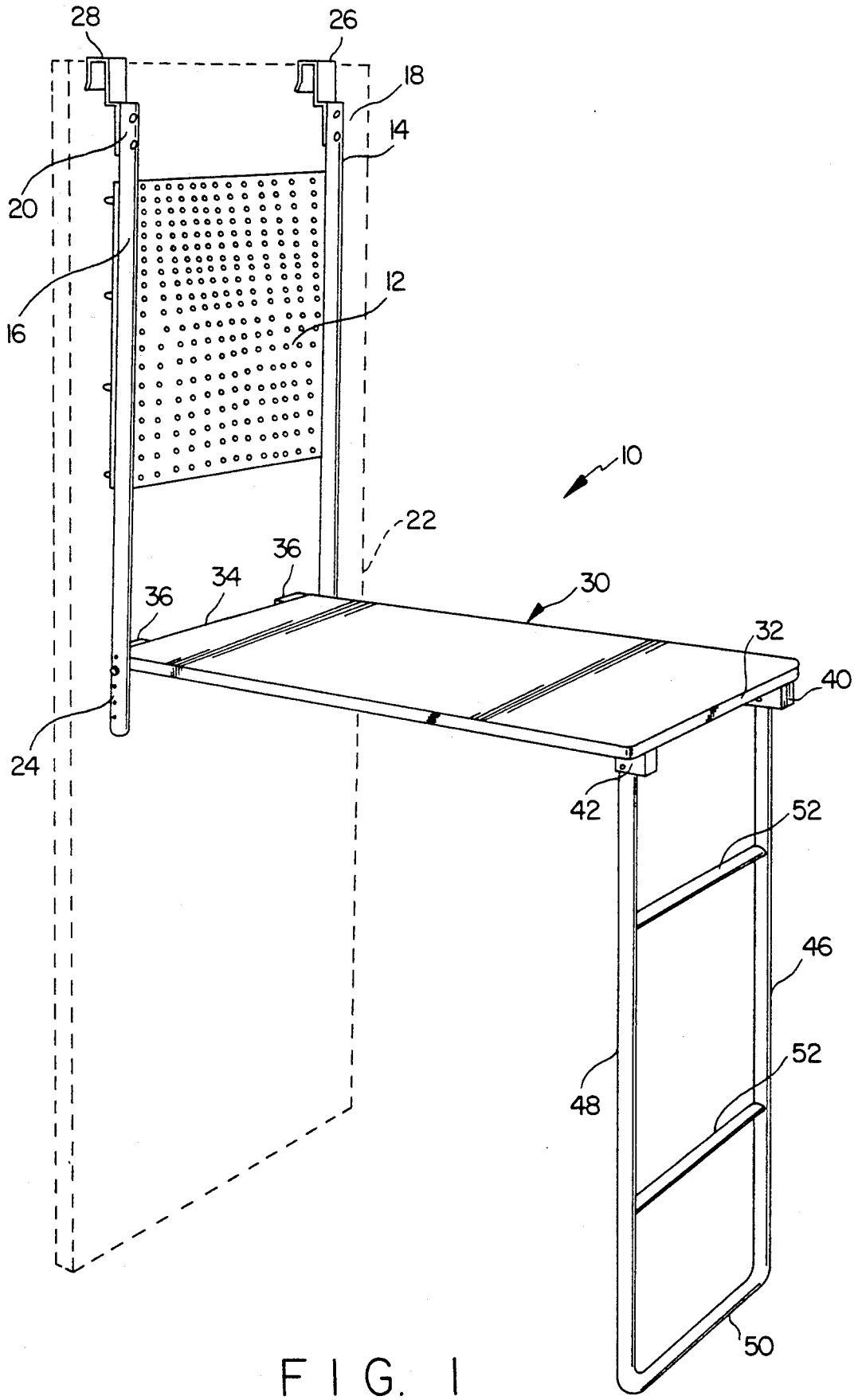
FIG. 1 is a perspective exploded view of the embodiment of the invention.

Referring to FIG. 1, an embodiment of the invention is shown generally at 10 and comprises a substantially rectangular, perforated back 12, such as a peg board.

Secured to the peg board on either side thereof are hang tubes 14 and 16. The hang tubes 14 and 16 have upper ends 18 and 20 and lower ends 22 and 24 respectively. Secured to the upper ends, such as by threaded fasteners, are overdoor hooks 26 and 28. Rotatably secured to the lower ends of the hang tubes is a benchtop 30 having a leading edge 32 and a trailing edge 34. The sides of the trailing edge 34 are rotatably secured to the lower ends 22 and 24 of the hang tubes.

Figure 2:
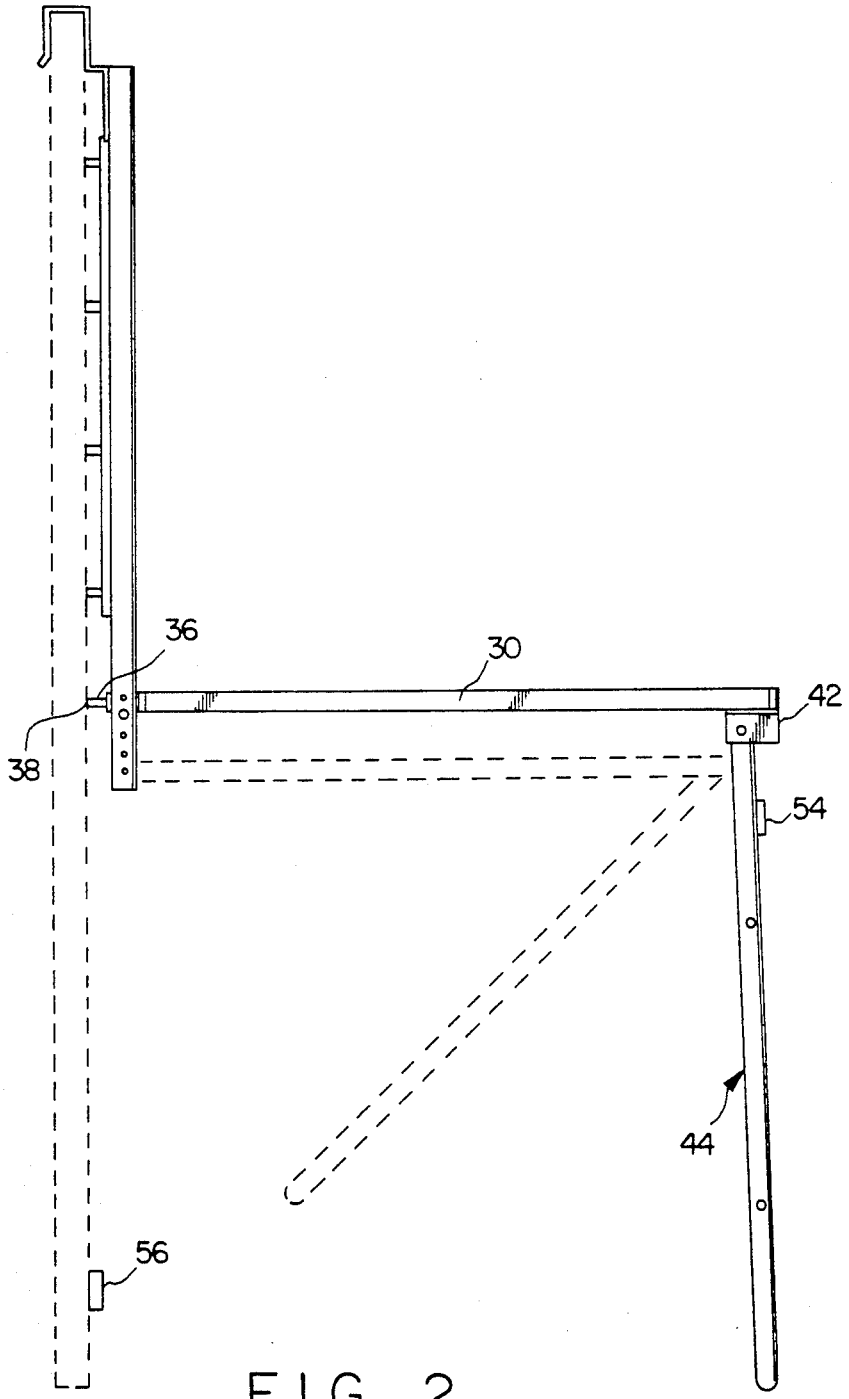
FIG. 2 is a side view of the invention in its open position.
Figure 3:
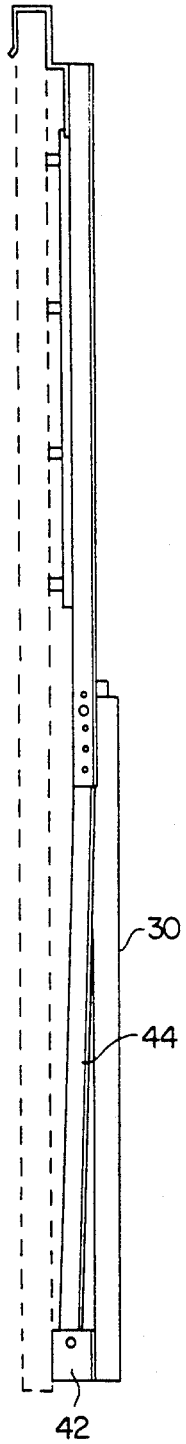
FIG. 3 is a side view of the invention in its closed position.

Referring to FIGS. 2 and 3, the trailing edge of the benchtop is secured to the lower ends of the hang tubes such that when the workbench is in its closed position, the benchtop 30 extends downwardly, the trailing edge of the benchtop does not contact the bottom edge of the back 12. Secured to the back edge of the benchtop 30 are Velcro strips 36. They are adapted to engage mating strips 38 which are secured to the door, shown in dotted lines, from which the workbench 10 is hung. The Velcro strips 36–38 stabilize the workbench 10.

Secured to the underside of the leading edge 32 of the benchtop 30 and at the corners thereof are brackets 40 and 42. A support bracket is shown generally at 44 comprises legs 46 and 48 in parallel spaced apart relationship joined integrally at their lower ends to a lower crossbar 50 for stability Immediate crossbars 52 are also secured to the legs.

Referring to FIG. 2, when the workbench is in its open position the benchtop 30 is substantially perpendicular to the plane of the back 12 and the bracket 44 is perpendicular to the plane of the benchtop. However, as shown in the dotted lines, the bracket 44 may be at an angle to the benchtop while still securing the benchtop in place. This is done by adjusting the position of the trailing edge of the benchtop to the lower ends of the hang poles 14 and 16.

As shown in FIG. 3, when the workbench is in its closed position, the bracket 44 is folded under the benchtop The front surfaces of the legs 44 have Velcro strips 54 attached thereto which engage corresponding Velcro strips 56 on the door, from which the workbench is suspended, to secure the workbench in place. The depending end of the legs 44–48 are received between the depending ends of the hang tube.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described our invention, what we now claim is:

1. A portable, collapsible workbench which comprises:

a substantially rectangular, perforated back having sides and an upper edge and a lower edge;

a pair of hang tubes secured to the sides of the back in parallel, spaced apart relationship, the hang tubes having upper ends extending beyond the upper edge of the back and lower ends extending beyond the lower edge of the back;

means secured to the upper ends of the hang tubes for clamping the upper end of the hang tubes to an upper surface of a support;

a benchtop having a underside an leading edge and a trailing edge, the trailing edge secured to the lower ends of the hang tubes in a moveable manner, support legs secured to the leading edge of the bench top, the support legs secured to the leading edge to move between an open position to support the benchtop in a substantially horizontal position and a closed position substantially parallel to the benchtop, the support legs being received between the lower ends of the hang tubes and the benchtop hanging downwardly from the hang tubes such that the support legs lay in substantially the same plane as the back when the support legs are in the closed position.

2. The workbench of claim 1 which includes:

means for securing the trailing edge of the benchtop to the hang tubes such that the support legs are substantially perpendicular to the benchtop when the support legs are in the open position.

3. The workbench of claim 1 which includes:

means for securing the trailing edge of the benchtop to the hang tubes such that the support legs are at an acute angle when the benchtop is in the substantially horizontal position.

4. The workbench of claim 1 which includes:

means for securing the support legs to the underside of the benchtop when the support legs are in the closed position and the benchtop hangs downwardly from the hang tubes.

5. The workbench of claims 1, 2, 3 or 4 which includes:

means for securing the trailing edge of the benchtop to an abutting surface when the support legs are in their open position and the benchtop is in the substantially horizontal position.

* * * * *